US006678955B2

(12) United States Patent
Takeshita et al.

(10) Patent No.: US 6,678,955 B2
(45) Date of Patent: Jan. 20, 2004

(54) APPARATUS AND METHOD OF WORKING INJECTION HOLE OF FLUID INJECTION NOZZLE

(75) Inventors: Kengo Takeshita, Kariya (JP); Shouichi Takenouchi, Toyota (JP); Mikiya Kurita, Toyoake (JP); Akinori Harata, Toyohashi (JP)

(73) Assignee: Denso Corporation, Kariya (JP)

( * ) Notice: Subject to any disclaimer, the term of this patent is extended or adjusted under 35 U.S.C. 154(b) by 302 days.

(21) Appl. No.: 09/969,126

(22) Filed: Oct. 3, 2001

(65) Prior Publication Data

US 2002/0038825 A1 Apr. 4, 2002

(30) Foreign Application Priority Data

Oct. 3, 2000 (JP) ..... 2000-303137

(51) Int. Cl.[7] ..... B21D 51/16; F02M 51/00

(52) U.S. Cl. ..... 29/890.142; 239/533.3; 239/533.11; 239/533.12; 239/585.2; 239/584; 239/533.14; 239/596; 29/557

(58) Field of Search ..... 239/533.1, 533.3, 239/533.9, 533.11, 533.12, 533.14, 583, 584, 585.1, 585.2, 585.3, 585.4, 585.5, 596, 598, 599; 29/890.142, 557; 72/327; 83/684, 685, 686

(56) References Cited

U.S. PATENT DOCUMENTS 4,907,748 A 3/1990 Gardner et al.
5,718,387 A * 2/1998 Awarzamani et al. .... 239/585.1
5,816,093 A * 10/1998 Takeuchi et al. ..... 72/327
5,911,366 A * 6/1999 Maier et al. ..... 239/553.3
5,992,280 A * 11/1999 Oishi et al. ..... 83/686
6,109,086 A * 8/2000 Gambrel et al. ..... 72/326
6,131,827 A * 10/2000 Kurita et al. ..... 239/533.2
6,286,769 B1 * 9/2001 Gunji et al. ..... 239/585.1
6,505,535 B1 * 1/2003 Kurita et al. ..... 83/34

FOREIGN PATENT DOCUMENTS

JP 2565407 10/1996

* cited by examiner

*Primary Examiner*—Robin O. Evans
(74) *Attorney, Agent, or Firm*—Nixon & Vanderhye P.C.

(57) ABSTRACT

It is an object of the invention to provide a method of working an injection hole of an electromagnetic type fuel injection valve so that when extrusion by using a punch is adopted, the punch does not break, even in the case where a central axis line of the injection hole of the electromagnetic type fuel injection valve is inclined to a line perpendicular to a face of a plate-like material to be punched. A front end, tapered portion of the punch is inclined in a direction opposed to a plate-like material relative to a central axis line of the punch to facilitate the punch along a sliding, inner face of a punch holder. While achieving a reduction in production cost, the divergent-shaped injection hole can accurately be formed in the plate-like material. A side force (Fs) is produced when the front end portion of the punch impinges on the plate-like material. The side force (Fs) is canceled by a reaction force (Fr) on a side opposed to the plate-like material and a bending moment potentially causing breakage of the punch is avoided.

9 Claims, 10 Drawing Sheets

APPARATUS AND METHOD OF WORKING INJECTION HOLE OF FLUID INJECTION NOZZLE

CROSS REFERENCE TO RELATED APPLICATION

This application is based on an incorporates herein by reference Japanese Patent Application No. 2000-303137 filed on Oct. 3, 2000.

BACKGROUND OF THE INVENTION

1. Field of the Invention

The present invention relates to a method of working an injection hole of a fuel injection nozzle plate of a fuel injection valve for injecting fuel into an internal combustion engine. The injection hole having a diverging shape with an increasingly larger diameter from a fluid inlet to a fluid outlet.

2. Description of the Related Art

Generally known in the art is an electromagnetic type fuel injection valve arranged with a thin plate having a plurality of injection holes on a downstream side of a fuel valve portion. The fuel injection valve portion further possesses a nozzle needle and a valve seat of a valve body for injecting fuel from the respective injection holes. It is conventional that the injection holes formed in a plate for fuel injection are provided with a diameter which stays the same from a fuel inlet to a fuel outlet, however, according to U.S. Pat. No. 4,907,748, there is shown a plate with an injection hole formed in a diverging shape, that is, injection holes that increase in diameter from the fuel inlet to the fuel outlet.

In recent years, there has been expedited needs for highly small particle formation of sprayed fuel in an electromagnetic type fuel injection valve and there has been requested high precision working of an injection hole formed in a orifice plate integrated to a front end face of a valve body to close an opening formed at a front end portion of the valve body. Heretofore, small particle formation of sprayed fuel in an electromagnetic type fuel injection valve has been dealt with by miniaturization and large angle formation of an injection hole.

However, as a method of working an injection hole for forming an injection hole in a diverging shape in a plate-like material, removal machining such as electric discharge machining (EDM) has been used which takes a working time period of several tens of seconds. Experience with EDM proves that the dimensional accuracy is poor as is the accuracy of a flow rate of sprayed fuel. At the same time, when the number of electric discharge machines is increased for the purpose of producing a number of parts to meet market demands, large expenses are required in plant and equipment investment resulting in increased production costs.

Hence, there is conceivable a method of extrusion using a punch for working an injection hole which is capable of resolving the above-described problem. However, when a central axis line of an injection hole is at an angle to a line perpendicular to a face of a plate-like material before working the desired injection hole, there is a possibility of breaking the punch due to the existence of a side force exerted on the punch when the front end of the punch impinges on the plate-like material (this is a force orthogonal to the central axis line of the punch). Therefore, it has been difficult to adopt extrusion methods using a punch as the method of working the injection hole.

SUMMARY OF THE INVENTION

It is an object of the invention to realize a method of working an injection hole of a fluid injection nozzle capable of reducing production costs and capable of increasing productivity. Further, it is an object to achieve dimensional accuracy of the injection hole and accuracy of a fluid flow rate which has not been achievable by removal working methods such as electric discharge machining (EMD) or press-punching. Further, it is an object to realize an apparatus of working an injection hole of a fluid injection nozzle in which even when extrusion using a punch is adopted, the punch will not break.

According to a first aspect of the invention, there is adopted an apparatus of working an injection hole of a fluid injection nozzle having a die mounted with a plate-like material, a punch substantially in the shape of a truncated circular cone, a shape of a front end portion of which is provided with a first inclination angle and a second inclination angle relative to a line perpendicular to a face of the plate-like material, a punch guide having a support hole slidably supporting the punch such that a central axis line of the punch is inclined to a perpendicular line of the face of the plate-like material, and punch driving means for advancing the punch in a direction of a central axis line of the punch guide.

Further, when a central axis line of the injection hole is inclined to a perpendicular line of the plate-like material face, by using a die structure capable of receiving a side force at a front end portion of the punch produced by working the injection hole, an inner face of the injection hole can be provided with a uniform face condition. That is, the face condition will be uniform over an entire region of the inner face of the injection hole without producing a broken face as in conventional press-punching. Therefore, a method is realized whereby working an injection hole of a fluid injection nozzle reduces production costs and improves productivity.

Further, by adopting extrusion using the punch, dimensional accuracy and accuracy in a flow rate is achievable. Accuracy and flow rates are not achievable by removal working methods such as electric discharge machining or press-punching. Further, the side force (force in a direction orthogonal to a central axis line of the punch) evident when the front end portion of the punch reaches the injection hole, can be opposed by a sliding face of the punch guide on a side opposed to the plate-like material. The side force is canceled by a reaction force, therefore a bending moment for breaking the punch is not created. Therefore, the punch is not broken by the side force produced when the front end portion of the punch reaches the injection hole.

According to a second aspect of the invention, a sliding face of the punch guide on which the front end portion of the punch slides is provided with the first inclination angle relative to the perpendicular line of the face of the plate-like material. The shape of the front end portion of the punch is constituted by a shape along the sliding face of the punch guide by inclining the front end portion of the punch guide in a direction opposed to a direction of the plate-like material relative to the central axis line of the punch. An effect (material removal effect) similar to that of the invention described in the first aspect can further be expected.

According to a third aspect of the invention, in working (forming) the injection hole, in a state in which the plate-like material is held between the die and the punch guide, there is carried out extrusion by pressing the front end portion of the punch into the plate-like material by advancing the punch along the central axis line of the punch guide in the direction of the plate and extruding a volumetric portion which the front end portion of the punch contacts as the punch progresses. The shape of the front end portion of the punch penetrates the plate-like material to thereby form the injection hole having the desired punch shape. An effect similar to that of the invention described in the first aspect can be expected to a further degree.

According to a fourth aspect of the invention, there are provided press dies setting a clearance between the front end portion of the punch and the die in a predetermined range relative to a plate thickness of the plate-like material. Further, the plate-like material is formed with the desired shape of the injection hole by executing a step of removing an extruded volumetric portion, which the front end portion of the punch presses and expels after the extrusion, by cutting, machining, or grinding the extruded portion at a level consistent with the face of the plate-like material.

According to a fifth aspect of the invention, there are provided press dies setting a clearance between the front end portion of the punch and the die to be equal to or smaller than a predetermined value. Further, the desired shape of the injection hole is formed in the plate-like material by pressing the punch until the extruded volumetric portion, which the front end portion of the punch presses to exclude, is separated from the plate-like material in the extrusion. The removing step is abolished and therefore, production costs are reduced.

DETAILED DESCRIPTION OF PREFERRED EMBODIMENTS

Embodiments of the present invention will be described with reference to the accompanying drawings.

Figure 1A:
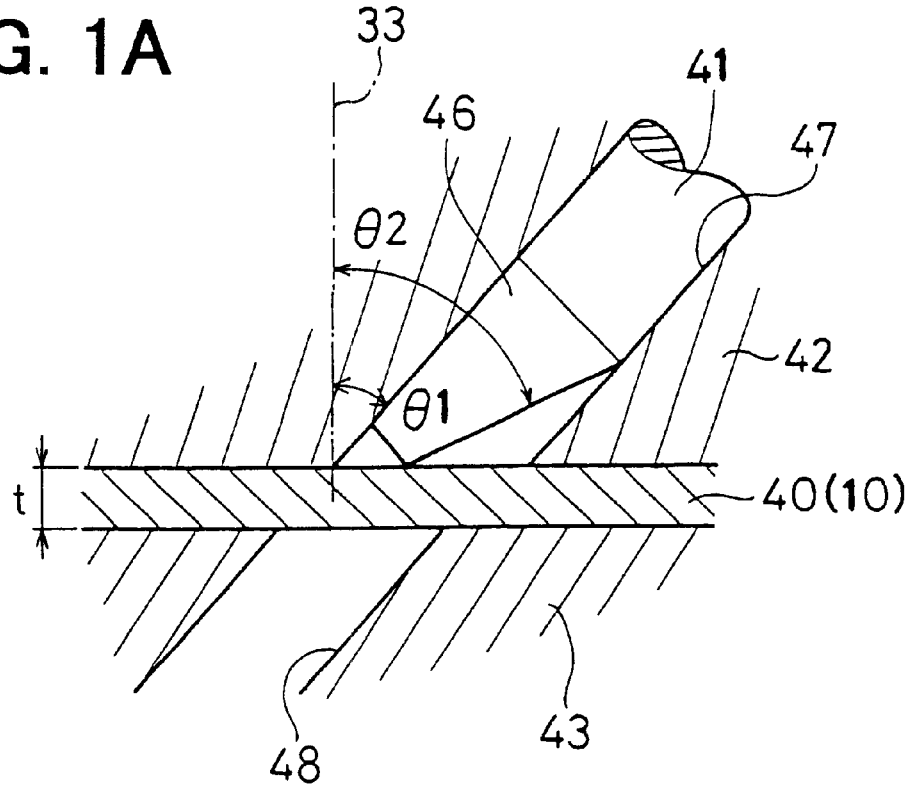
FIG. 1A is a schematic view showing a method of working an injection hole of an electromagnetic type fuel injection valve according to an embodiment of the invention.
Figure 1B:
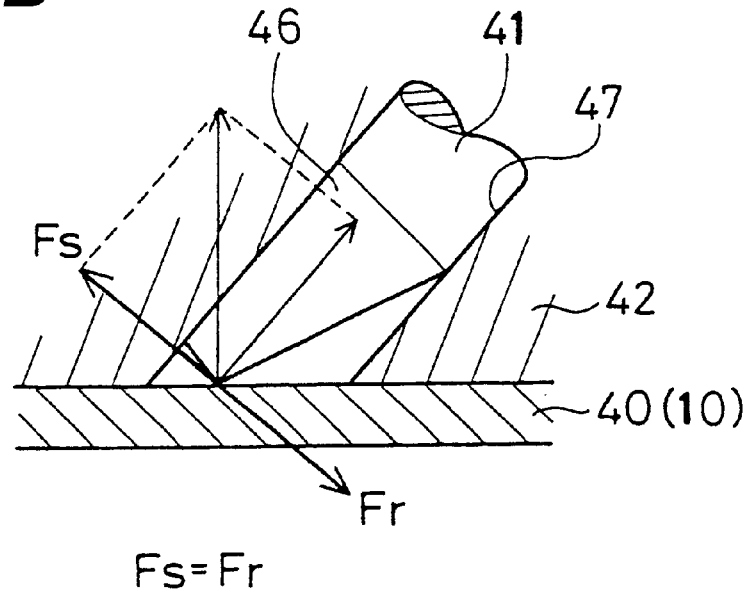
FIG. 1B is a schematic view showing a method of working an injection hole of an electromagnetic type fuel injection valve according to an embodiment of the invention.
Figure 2:
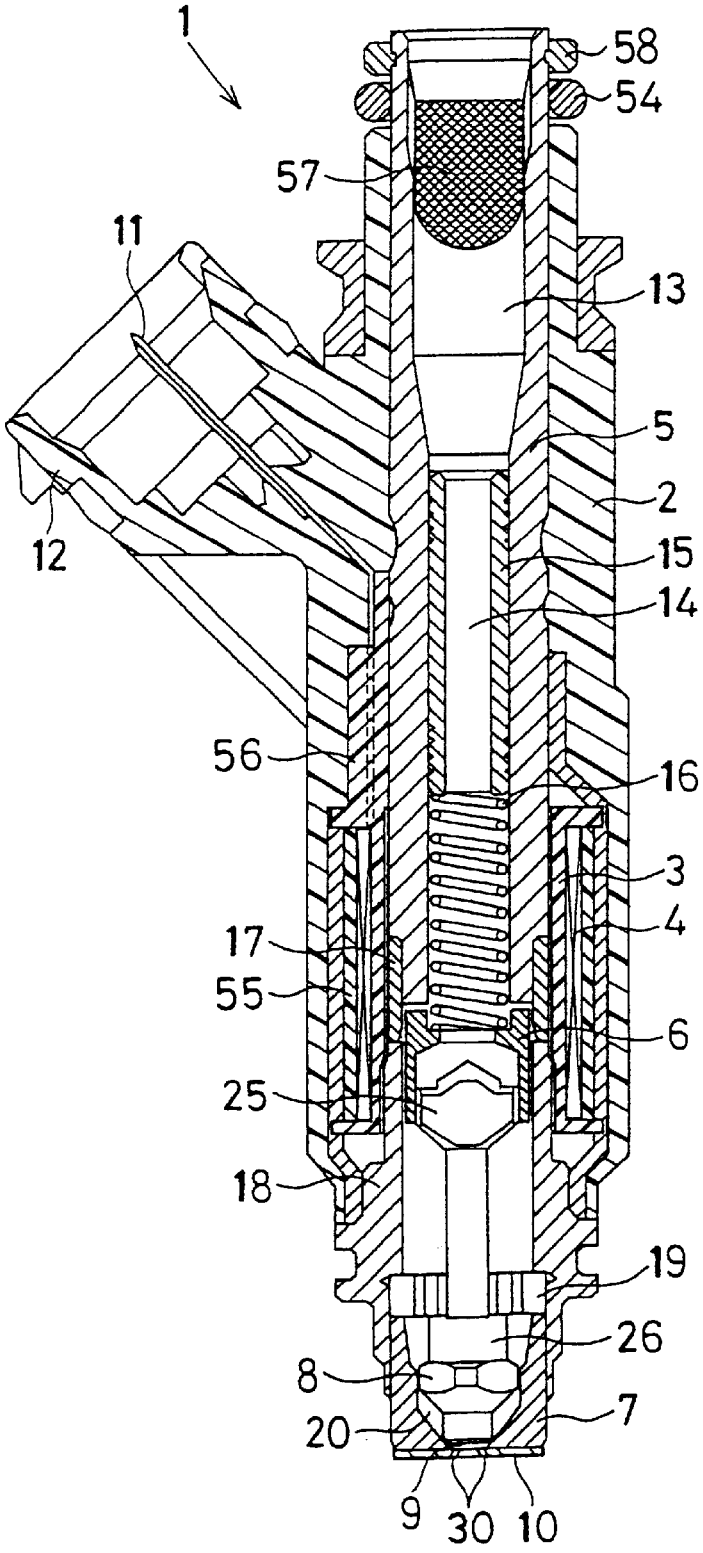
FIG. 2 is a cross-sectional view of the electromagnetic type fuel injection valve according to an embodiment of the invention.
Figure 3A:
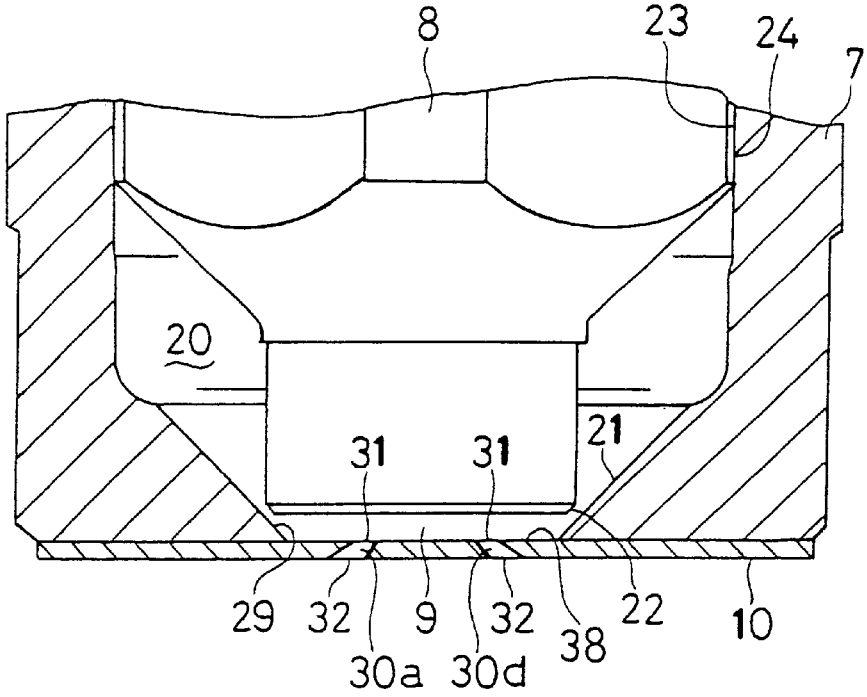
FIG. 3A is an enlarged cross-sectional view showing a fuel injection nozzle of the electromagnetic type fuel injection valve according to an embodiment of the invention.
Figure 3B:
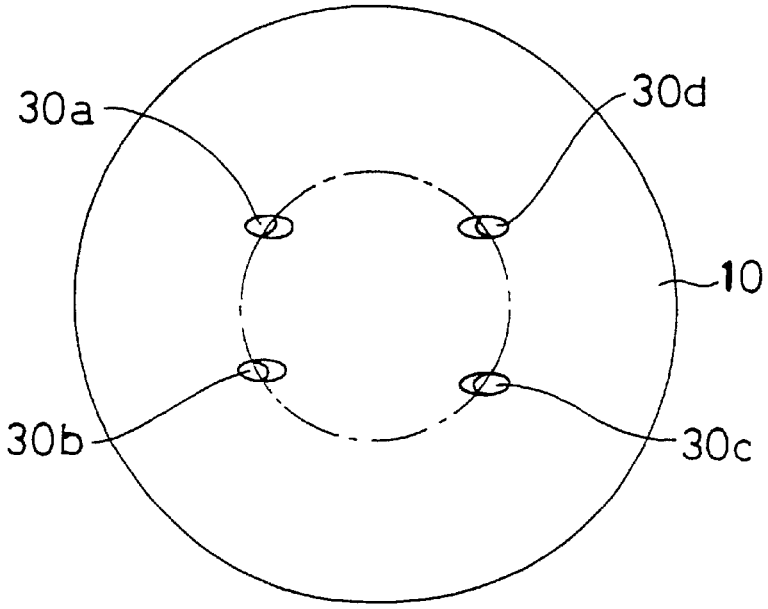
FIG. 3B is a plan view showing a plate with an injection hole viewed from a fuel inlet side according to an embodiment of the invention.

FIG. 1A through FIG. 9B show an embodiment of the invention, FIG. 2 is a cross-sectional view showing an example of applying a fuel injection nozzle to an electromagnetic type fuel injection valve of a gasoline engine, FIG. 3A is a view showing a fuel injection nozzle of the electromagnetic type fuel injection valve and FIG. 3B is a view showing a plate with and injection hole viewed from a fuel inlet side.

An electronically controlled fuel injection apparatus of an embodiment of the present invention comprises sensors for detecting a fuel supply system, an intake system, and an operating state of an internal combustion engine. Additionally, an electronic control unit (ECU) is provided for governing and controlling these components. Among them, the fuel supply system is a system capable of; 1) pressurizing fuel to a constant pressure by utilizing an electric type fuel pump (not illustrated); 2) delivering the fuel to an electromagnetic type fuel injection valve 1 (FIG. 2) via a delivery pipe (not illustrated); and 3) injecting the fuel at optimum timings.

The electromagnetic type fuel injection valve 1 is a fuel injector having a function of expediting a small particle formation of sprayed fuel (from a plate with an injection hole(s)) sprayed to a vicinity (intake port) of an intake valve (suction valve) in an internal combustion engine such as a gasoline engine (hereinafter, referred to as "engine") with proper and efficient timings. Further, a number of the electromagnetic type fuel injection valves 1 in accordance with a number of cylinders of the engine, are integrated into an intake manifold (intake pipes) which supply air for internal combustion.

With continued reference to FIG. 2, the electromagnetic type fuel injection valve 1 is composed of a housing mold 2, an electromagnetic coil (solenoid coil) 4 wound around an outer periphery of a coil bobbin 3 made of resin arranged in the housing mold 2, a fixed core (stator) 5 substantially in a cylindrical shape fixed in the housing mold 2, a movable core (armature) 6 movable in the axial direction, a valve body 7 provided at a front end side of the housing mold 2, a nozzle needle 8 contained in the valve body 7 and a plate with injection hole (orifice plate) 10 forming a fuel path 9 between the orifice plate 10 and one end face (front end face) of the nozzle needle 8 in the axial direction.

The housing mold 2 is integrally molded with a resin material. At an inside of the housing mold 2, the coil bobbin 3 and the fixed core 5 and an outside connecting terminal (terminal) 11 are integrally molded. Further, at an outer periphery of the coil bobbin 3 and the electromagnetic coil 4, a resin mold 55 surrounding the electromagnetic coil 4 is integrally molded. Further, at an upper side of the housing mold 2, there is provided a connector portion 12 that projects from an outer wall of the housing mold 2 at a predetermined inclination angle. Further, the outside connecting terminal (terminal) 11 electrically connected to the electromagnetic coil 4, is embedded in the connector portion 12 and a resin mold 56. Further, the outside connecting terminal 11 is connected to an ECU, not illustrated, via a wire harness.

The fixed core 5 is composed of a ferromagnetic material and is provided in the resin housing mold 2 to project upwardly from an upper end face of the housing mold 2. Further, at an inside of the fixed core 5, a fuel path 13 is formed in the axial direction. At an inner peripheral face of the fixed core 5, there is provided an adjusting pipe 15 substantially in a cylindrical shape having an axial hole 14. The adjusting pipe 15 sets a load (valve opening pressure) of a coil spring 16 by displacing the spring 16 in the axial direction at an inside portion of the fixed core 5 and is fixed to the inner peripheral face of the fixed core 5 after setting the adjusting pipe 15.

Furthermore, with continued reference to FIGS. 2 and 3A, one end of the coil spring 16 is brought into contact with a front end face of the adjusting pipe 15. The other end of the coil spring 16 is brought into contact with the movable core 6 which is fixedly welded to an upper end face of the nozzle needle 8. The coil spring 16 seats a seat portion 22 of the nozzle needle 8 on a valve seat 21 of the valve body 7 by urging the movable core 6 and the nozzle needle 8 to a lower portion of the electromagnetic type fuel injection valve 1. Further, when excitation current flows from the outside connecting terminal 11 to the electromagnetic coil 4 by ECU, the movable core 6 and the nozzle needle 8 are sucked in the direction of the fixed core 5, against the spring force of the coil spring 16.

Further, one side of the fixed core 6 in the axial direction is arranged with a nonmagnetic pipe 17 and a magnetic pipe 18. The nonmagnetic pipe 17 is composed of a nonmagnetic material and is formed substantially in a cylindrical shape. The nonmagnetic pipe 17 is connected to a lower end of the fixed core 5. Further, the magnetic pipe 18 is composed of a magnetic material and is formed using stepped portions. The magnetic pipe 18 is connected to a lower end of the nonmagnetic pipe 17. A space inward from the nonmagnetic pipe 17 and the magnetic pipe 18 houses the movable core 6 comprising a magnetic material and formed in a cylindrical shape.

Further, the valve body 7 is laser welded into the magnetic pipe 18, after facilitating the insertion of the valve body 7 with a hollow, circular disk spacer 19, which abuts the magnetic pipe 18. A thickness of the spacer 19 is adjusted to maintain an air gap between the fixed core 5 and the movable core 6 at a predetermined value. Here, an electromagnetic type actuator is composed of the housing mold 2, the electromagnetic coil 4, the fixed core 5, the movable core 6, the nonmagnetic pipe 17, the magnetic pipe 18 and so forth.

Next, a simple explanation pertaining to the structures of the valve body 7 and the nozzle needle 8 according to the embodiment of FIGS. 2–3B will be provided. The valve body 7 and the nozzle needle 8 are formed in predetermined shapes by a metal material such as SUS. Further, inside of the valve body 7, there is formed a fluid fuel path 20. There is formed a clearance for passing fuel between a cylindrical face 23 of the valve body 7 and four faced portions formed at a sliding portion 24 of the nozzle needle 8. Further, a valve portion is composed of the valve seat 21 of the valve body 7 and the seat portion 22 at a front end of the nozzle needle 8.

The nozzle needle 8 is a valve member for closing the fuel path 20 by being seated on the valve seat 21 of the valve body 7 and opening the fuel path 20 by separating from the valve seat 21. Shown in FIG. 2, a coupling portion 25 is formed at an upper portion of the nozzle needle 8. Further, by laser welding the coupling portion 25 and the movable core 6, the movable core 6 and the nozzle needle 8 are integrally connected. An outer periphery of the coupling portion 25 is faced to accommodate a fuel path. Further, when the movable core 6 is attracted by the fixed core 5 by generating a magnetomotive force in the electromagnetic coil 4, the nozzle needle 8 is lifted until a flange portion 26 is brought into contact with the spacer 19.

Here, a valve main body of the electromagnetic type fuel injection valve 1 is composed of the valve body 7 and the orifice plate 10 and the valve member of the electromagnetic type fuel injection valve 1 is composed of the nozzle needle 8. Additionally, a filter 57 is mounted to an upper side of the fuel path 13 formed in the fixed core 5. The filter 57 removes foreign matter such as dust and dirt in pressurized fuel from a fuel tank. The fuel, pressurized by a fuel pump, flows into the electromagnetic type fuel injection valve 1. Further, a detachment preventive member 58 of an O-ring 54 is mounted to an upper end portion of the fixed core 5.

Figure 4A:
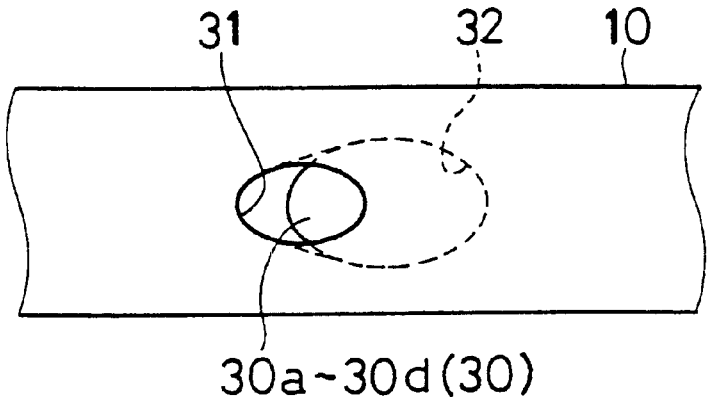
FIG. 4A is a plan view showing a shape of an injection hole of the plate according to an embodiment of the invention.

Next, a simple explanation will be given pertaining to the structure of the orifice plate 10 according to the embodiment of FIG. 2 through FIG. 4B. Here, FIGS. 4A and 4B are views showing a shape of an injection hole of the orifice plate.

With reference to FIG. 3A, the orifice plate 10 is fixed to a front end face of the valve body 7, by using welding means such as laser welding, to close an opening 29 in the shape of a circular hole formed in the valve body 7. The orifice plate 10 is composed of a metal material such as SUS. Further, FIG. 3B shows that orifice plate 10 is formed with a plurality of injection holes (orifices) 30*a* through 30*d* for controlling directions of spray fuel and expediting small particle formation of spray fuel. Four of the injection holes 30*a* through 30*d* are of a tapered shape formed by a single step of pressing according to the invention and arranged on an imaginary line of one circle centering on a central axis line of the orifice plate 10 of the electromagnetic type fuel injection valve 1.

FIG. 3A shows the plurality of injection holes 30*a* through 30*d* are respectively formed to perforate the orifice plate 10 to be directed from fuel inlets 31 to fuel outlets 32. Additionally, the injection holes 30*a* through 30*d* are inclined in a direction so that the central axis line of the electromagnetic type fuel injection valve 1 is closest to an upstream side relative to a direction of flowing fuel of the fuel path 9 that flows through the injection holes 30*a* through 30*d*. The injection holes 30*a* through 30*d* are manufactured at a predetermined inclination angle and gradually widened (tapered) from the fuel inlets 31 to the fuel outlets 32. That is, each of the injection holes 30*a* through 30*d* is a passage that diverges or gradually widens from the fuel inlet 31 to the fuel outlet 32.

Figure 4B:
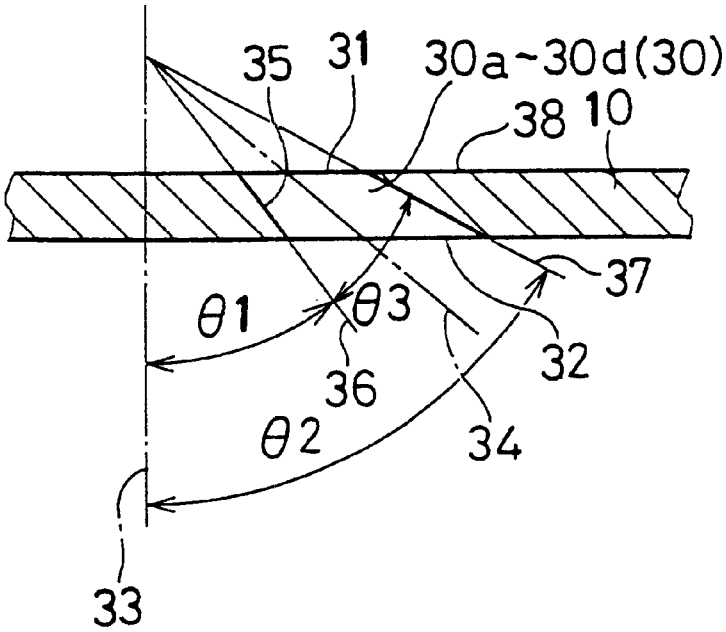
FIG. 4B is a cross-sectional view showing the shape of the injection hole of the plate according to an embodiment of the invention.

Further, with reference to FIG. 4B, the respective injection holes 30*a* through 30*d* are formed to depart from a perpendicular line (central axis line) 33 orthogonal to a face of the orifice plate 10 toward a desired fuel injection direction. Shapes and sizes of the respective injection holes 30*a* through 30*d* are the same and magnitudes of θ1, θ2 and θ3, discussed later, are equal to each other with respect to each respective injection hole. The injection holes 30*a*–30*d* are respectively formed in the same directions relative to the central axis line 33 of the orifice plate 10. A direction of injecting fuel from the injection holes 30*a* and 30*b* and a direction of injecting fuel from the injection holes 30*c* and 30*d*, are oppositely directed by 180° and the electromagnetic type fuel injection valve 1 carries out injection in two directions.

Now, typical angles of the injection holes 30*a*–30*d* of the orifice plate 10 will be denoted. Here, as shown by FIG. 4B, an intersection between an imaginary face including an injection hole central axis line 34 and orthogonal 33 to the orifice plate 10 will be used to identify specific angles. For instance, an injection hole inner face 35 of the orifice plate 10, a first inclination angle formed by a first intersection 36 on a side of an obtuse angle formed by the injection hole central axis line 34 and a fuel inlet side end face 38 of the orifice plate 10, and the central axis line 33, is designated by notation θ1. A second inclination angle formed by a second intersection 37 on a side of an acute angle formed by the injection hole central axis line 34 and the fuel inlet side end face 38 of the orifice plate 10, and the central axis line 33, is designated by notation θ2. Then, there is provided a relationship of θ1<θ2. That is, in each of the respective injection holes 30*a* through 30*d*, the injection hole inner peripheral face 35 remote from the central axis line 33 of the orifice plate 10 relative to the injection hole central axis line 34, is inclined to the central axis line 33 more than the injection hole inner peripheral face 35 proximate to the central axis line 33 of the orifice plate 10 relative to the injection hole central axis line 34.

Further, when the first inclination angle is designated by notation θ1, θ1=15° through 45° or θ1 is equal to or larger than 15°. Further, when notation θ3 designates θ2−θ1, θ3=15° through 30° or θ3 is equal to or larger than 15°. Further, when a plate thickness of the orifice plate 10 is designated by notation t, t=0.05 through 0.20 mm or t is equal to or larger than 0.05 mm.

Next, a simple explanation will be given to operation of the electromagnetic type fuel injection valve 1 according to the embodiment depicted in FIGS. 2 through 4B.

When electricity flows to the electromagnetic coil 4 of the electromagnetic type fuel injection valve 1 by ECU, the movable core 6 is drawn by the fixed core 5 against the force of the coil spring 16 and the nozzle needle 8 the coupling portion 25 of which is laser welded to the movable core 6. The movable core 6 is lifted until the flange portion 26 is brought into contact with the spacer 19. Then, the valve portion comprising the valve seat 21 of the valve body 7 and the seat portion 22 of the nozzle needle 8, is opened. Thereby, fuel flowing into the fuel path 13 formed in the fixed core 5 of the electromagnetic type fuel injection valve 1 via the filter 57 by way of the delivery pipe after having been pressurized to a constant pressure by a fuel pump, passes from the axial hole 14 formed in the adjusting pipe 15 through a clearance at two faced portions formed at the coupling portion 25 of the nozzle needle 8.

Further, fuel passes through the clearance between the cylindrical face 23 of the valve body 7 and the four faced portions formed at the sliding portion 24 of the nozzle needle 8 and reaches the fuel path 9 between the valve seat 21 of the valve body 7 and the seat portion 22 of the nozzle needle 8. Further, fuel which passes between the valve seat 21 and the seat portion 22, impinges on a path wall face of the orifice plate 10 inside of the fuel path 9 and flows along the path wall face of the orifice plate 10. Further, fuel which flows from the fuel path 9 to the fuel inlets 31 of the injection holes 30*a* through 30*d*, flows from inside of the fuel path 9 toward path wall faces of the injection holes 30*a* through 30*d* without producing vortices around the fuel inlets 31 of the injection holes 30*a* through 30*d* and is injected from the fuel outlets 32 of the injection holes 30*a* through 30*d* to the intake valves of the engine with appropriate timing consistent with combustion requirements.

Figure 5A:
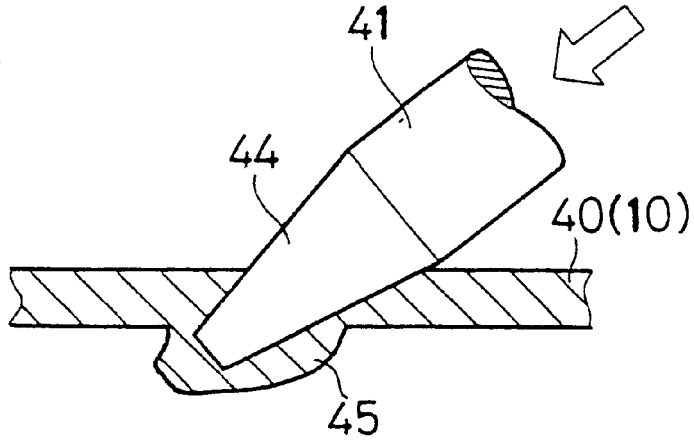
FIGS. 5A through 5C are schematic views showing a method of forming an injection hole of an electromagnetic type fuel injection valve (comparison example)
Figure 5B:
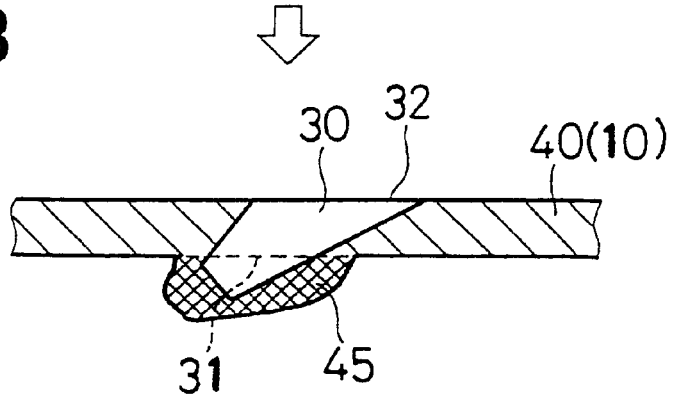
Figure 5C:
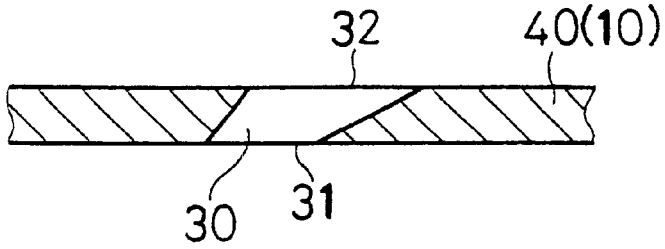

Next, an explanation will be given which pertains to a method of working the injection hole of the electromagnetic type fuel injection valve according to the embodiment referenced in FIGS. 1A through FIG. 9B. Here, FIG. 5A through FIG. 5C are process views showing the method of forming or working the injection hole of the electromagnetic type fuel injection valve (a comparative example).

Here, an apparatus of working the injection hole of the orifice plate 10, is provided with a successive feed apparatus for successively feeding a plate-like material 40 in the shape of a roll comprising a metal material such as SUS. The apparatus additionally comprises the orifice plate 10 housing an injection hole and having the plate thickness of "t" (FIG. 1A), press dies comprising an upper die and a lower die and an upper die drive apparatus for driving the upper die (not shown).

Continuing with reference to FIG. 1A, the upper die of the plate dies is provided with a punch 41 a central axis line of which is inclined to a central axis line 33 which is orthogonal to the face of the plate-like material, and a punch holder 42 (also serving as a punch guide according to the invention) for reciprocally supporting the punch 41. The punch 41 is supported in the direction of its central axis line and the lower die 43 of the press dies is provided for sandwiching and holding the plate-like member 40 between the die 43 and the punch holder 42 after the plate-like member 40 has been fed onto the end face of die 43. Further, with reference to FIGS. 5A–5C, a front end portion of the punch 41 is formed with a tapered portion 44 constituting a diverging (tapered) shape which is the same as that of the injection hole 30 for transcribing a predetermined shape of the injection hole 30.

First, in the press dies, by moving the punch 41 in its axial direction (provided with a predetermined inclination angle relative to the plate-like material 40) by the punch drive apparatus (punch driving means), the tapered portion 44 of the punch 41 is pressed into the plate-like material 40 fed by the successive feed apparatus. The shape of the front end portion of the punch 41 is transcribed to the plate-like material 40 (refer to FIG. 5A).

Then, at a face opposed to the face of the plate-like material 40 to which the tapered portion 44 of the punch 41 is pressed, there remains a useless portion 45 of a volume of plate material which the tapered portion 44 of the punch 41 excludes. Next, the useless portion 45 is removed at a height position consistent with the surface of the plate-like material 40 (FIGS. 5B and 5C). This results in the formation of the injection hole 30 having a desired shape, that is, the diverging (tapered) shape in which the diameter is widened from the fuel inlet 31 to the fuel outlet 32 (FIG. 5C).

According to the method of working the injection hole 30, an inner face of the injection hole 30 is provided with a face condition which is uniform over an entire region of the inner face of the injection hole 30 without producing a broken face as in press-punching. Thereby realized is the method of working the injection hole at a low cost and with high productivity, compared to other methods, and there is achieved a dimensional accuracy or accuracy of material removal which has not been able to achieve by removal working such as electric discharge machining or press-punching. Additionally, fluid flow rates through the injection hole 30 are more accurate as a result of the material removal method.

Further, the plate-like material 40 is rotated on the lower die, or a pressing machine is shifted such that the injection holes are perforated by a number of punches 41, arranged at the orifice plate 10. By repeating the injection hole forming, the orifice plate 10 having the injection holes 30 each in the tapered shape, gradually widening from the fuel inlet 31 to the fuel outlet 32, can be produced in a quantity to meet market needs.

Figure 6A:
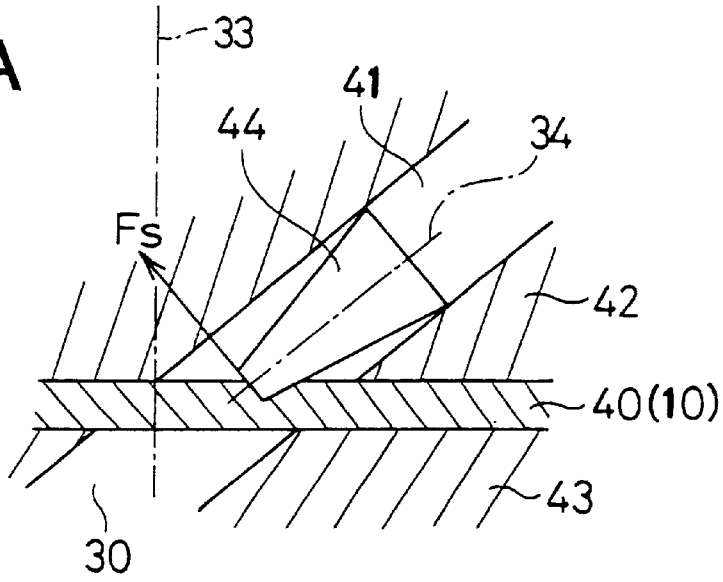
FIG. 6A is a schematic view showing an example of a prior art punch being forced into a plate with the resulting force being indicated (comparison example)
Figure 6B:
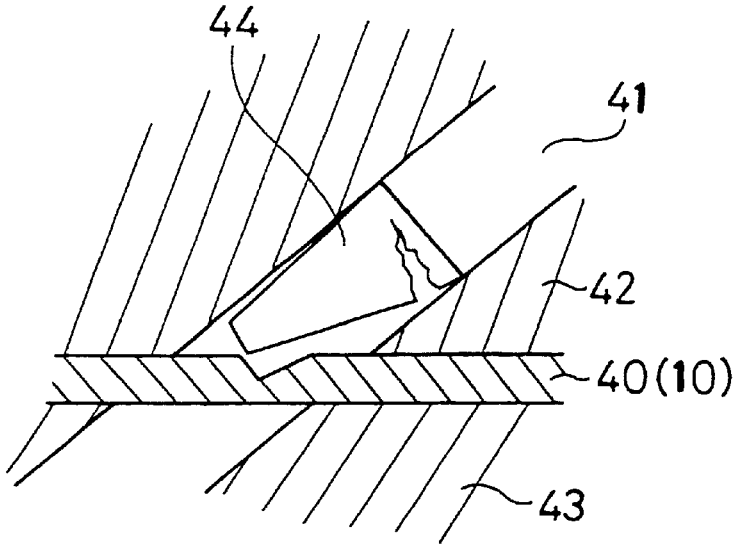
FIG. 6B is a schematic view showing an example of a prior art punch breaking as a result of the force in FIG. 6A (comparison example)
Figure 7:
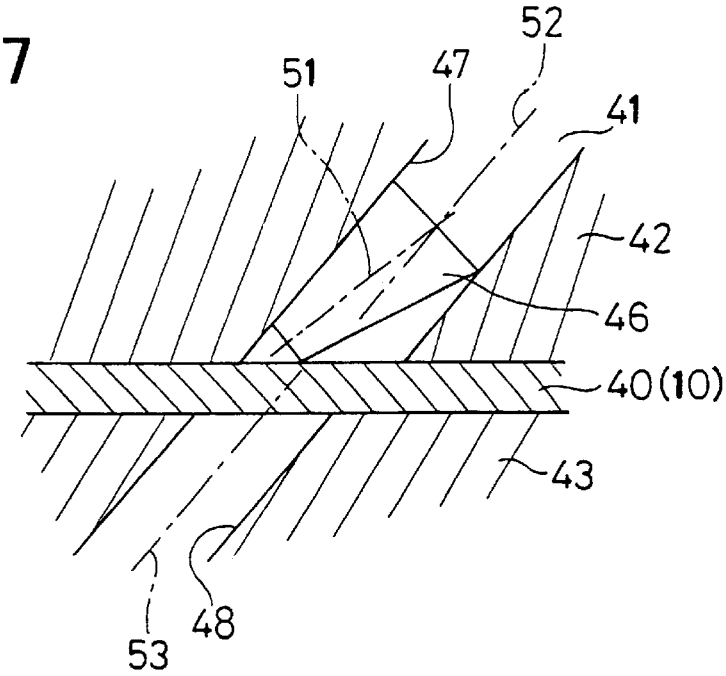
FIG. 7 is a schematic view showing a method of working an injection hole of the electromagnetic type fuel injection valve according to an embodiment of the invention.

Here, when the central axis line (injection hole central axis line 34) of the injection hole 30 of the electromagnetic type fuel injection valve 1 is inclined to the line orthogonal to the face of the plate-like material 40, as shown by FIG. 6A, FIG. 6B shows that there is a possibility of breaking the punch 41 by a side force Fs (force in a direction orthogonal to the central axis line of the punch 41). The force Fs is produced when the front end portion of the punch 41 impinges on the plate-like material 40, that is, in working or forming the injection hole 30. In this case, by adopting a press die structure shown by FIGS. 1A, 1B and 7, the tapered inclined hole is formed to penetrate the plate-like material 40 by a single step of pressing without breaking the punch 41. That is, the front end tapered portion 46 is inclined in such a way so that it is coincident with the punch 41 periphery and parallel to a central axis line 52 of the punch 41 to thereby constitute a shape consistent with the sliding face 47 (inner face) of the punch holder 42 (FIG. 7).

With reference to FIG. 1A, the tapered portion 46 of the punch 41 is provided with a tapered inclined shape (substantially a shape of an elliptic cone) having a first inclination angle θ1 and a second inclination angle θ2 relative to the central axis line 33 orthogonal to the face of the plate-like material 40. Further, FIG. 7 shows that the punch holder 42 is formed with a support hole 47 for covering a total periphery of the punch 41 and slidably supports the punch 41 in a direction consistent with a central axis line 52 of the punch holder 42 such that the central axis line 51 of the punch 41 is inclined. Further, on an inner face of the punch holder 42, a sliding face on which the tapered portion 46 of the punch 41 slides, is provided with the first inclination angle θ1 relative to the central axis line 33 of the orifice plate 10 which is orthogonal to the face of the plate-like material (FIG. 1A). Further, a discharge hole 48 capable of discharging the useless portion 45 is formed at the die 43 the upper end face of which is mounted with the plate-like material 40 in a direction conducive to a central axis line 53 of the die 43.

Figure 8A:
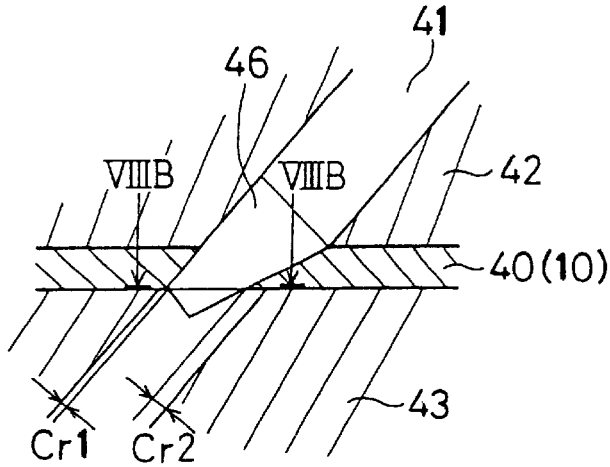
FIG. 8A is a schematic view showing a method of forming an injection hole of the electromagnetic type fuel injection valve according to an embodiment of the invention.
Figure 8B:
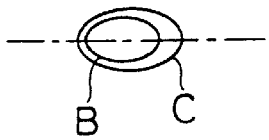
FIG. 8B is a cross-sectional view taken along line VIIIB—VIIIB of FIG. 8A according to an embodiment of the invention.

Further, as shown by FIGS. 8A and 8B, in working the injection hole by extruding the useless (waste) portion 45 (FIG. 5B) of the volume pressed by the tapered portion 46 of the punch 41, when clearances between the tapered portion 46 in the tapered inclined shape of the punch 41 and the upper end face of the die 43, are designated by notations of Cr1 and Cr2, the clearance Cr1 is set to 0 through 70% of the plate thickness (t) of the plate-like material 40 and the clearance Cr2 is set to 0 through 120% of the plate thickness (t) of the plate-like material 40. Further, in FIG. 8B, notation B indicates a sectional shape of the punch 41 and notation C indicates a sectional shape of the die 43 (elliptical shape similar to the sectional shape of the punch 41).

Figure 9A:
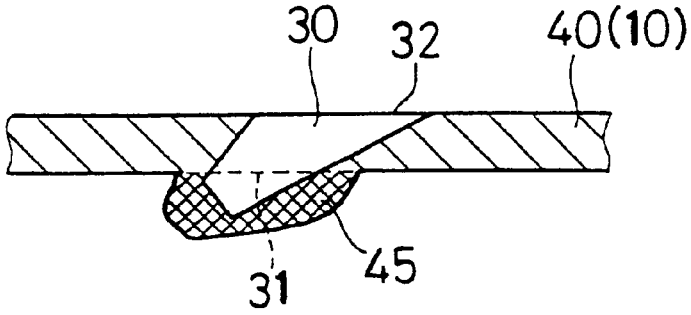
FIG. 9A is a schematic view showing a method of forming an injection hole of the electromagnetic type fuel injection valve according to an embodiment of the invention.
Figure 9B:
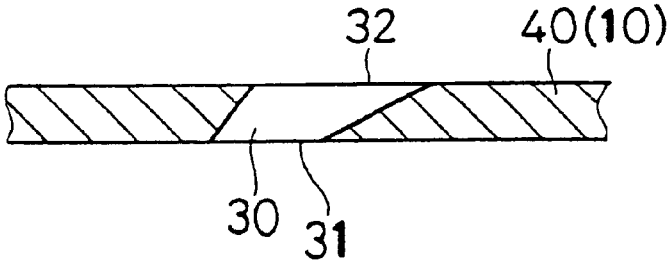
FIG. 9B is a schematic view showing a method of forming an injection hole of the electromagnetic type fuel injection valve according to an embodiment of the invention.

According to the method of working the injection hole of the orifice plate 10 in accordance with the present invention, in working the injection hole, as shown by FIGS. 1A, 1B, 7, 8A and 8B, there is carried out an extrusion capable of forming the injection hole 30 having the desired shape with high dimensional accuracy at the plate-like material 40 by transcribing the shape of the tapered portion 46 of the punch 41 to the plate-like material 40. The transcribing is carried out by advancing the punch 41 in accordance with the direction of the central axis line of the punch holder 42 with the plate-like material 40 sandwiched and held between the upper end face of the die 43 and the lower end face of the punch holder 42. The tapered portion 46 of the punch 41 is pressed to the plate-like material 40, and the useless portion 45 (FIG. 5B) of the volume pressed and excluded by the tapered portion 46 of the punch 41 forwardly extrudes from the face of the plate-like material (FIG. 9A). After the extrusion, the useless portion 45 is removed at a level consistent with the surface of the plate-like material 40 (FIG. 9B).

When the injection hole central axis line 34 of the injection hole (FIG. 4B) is inclined relative to the orthogonal line 33 and relative to the face of the plate-like material 40, (FIGS. 4B and 1B) a side force (Fs) is produced when the front end portion of the punch 41 impinges on the plate-like material 40. In working the injection hole, the force Fs can be received by the sliding face (inner face) of the support hole 47 of the punch holder 42 on the side opposed to the plate-like material 40. That is, the side force (Fs) is canceled by a reaction force (Fr) and there is no resulting bending moment to break or damage the punch 41 (FIG. 1B). Further, with regard to a material of the punch 41, it is preferable to use a material that is strong enough to withstand the side force (Fs) produced in working the injection hole (for example, cemented carbide). Further, with regard to a material of the punch holder 42, it is preferable to use a material capable of withstanding the side force (Fs). Although according to the embodiment, the entire area surrounding the punch 41 is covered by the punch holder 42, the punch holder 42 may be present only in the direction of the side force (Fs). For example, a punch holder having a partially circular arc shape is used.

As described above, by adopting the method of working the injection hole for forming the injection hole in the tapered shape by the single step of pressing, there is implemented a mechanism of expediting very small particle formations of sprayed fuel injected into the internal combustion engine with appropriate timing. That is, not only the working operation promoting the added value of a product having a plate 40 with injection whole 10 with a low cycle (manufacturing) time and high productivity but also a working (manufacturing) operation having high dimensional accuracy. The expense of plant and equipment investment is alleviated and a remarkable cost reduction is achieved.

Further, even in the case in which the injection hole central axis line 34 of the injection hole 30 of the electromagnetic type fuel injection valve 1 is inclined relative to the line orthogonal to the face of the plate-like material 40, the side force (Fs) produced in working the injection hole with the tapered portion 46 of the punch 41, can be opposed by the sliding face of the punch holder 42. That is, on the side opposed to the plate-like material 40, the side force (Fs) is canceled by the reaction force (Fr) and there is no resulting bending moment to break the tapered portion 46 of the punch 41. Therefore, the punch 41 is not broken by the side force (Fs) produced when the tapered portion 46 of the punch 41 impinges on the plate-like material 40 in working the injection hole.

Additionally, and with further reference to FIG. 7, the central axis line 53 of the discharge hole 48 of the die 43 is arranged in parallel with the central axis line 52 of the support hole 47 of the punch holder 42 and on the same axis line. An operator can adjust to align the punch 41 and the die 43 while visually observing the punch 41 and the die 43 and therefore, the working operation is performed with high dimensional accuracy.

Figure 10:
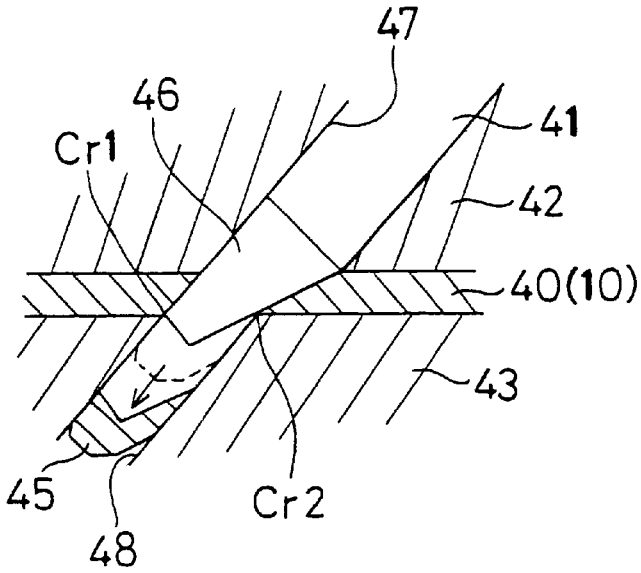
FIG. 10 is a schematic view showing a method of forming an injection hole of an electromagnetic type fuel injection valve according to an embodiment of the invention.

FIG. 10 shows another embodiment of the invention and is a view showing a method of working an injection hole of an orifice plate 40. According to the embodiment, when clearances between the tapered portion 46 of the punch 41 and the upper end face of the die 43 are designated by notations Cr1 and Cr2, the clearances are set such that Cr1=0–20% and Cr2=0–20% of the plate thickness (t). By making the clearances between the tapered portion 46 of the punch 41 and the upper end face of the die 43 to be equal to or smaller than predetermined values, in extrusion, the useless portion 45 is automatically discharged from the discharge hole 48 without requiring a removing step as in the first embodiment. The removal step is not necessary because the punch 41 causes the separation of the useless portion 45 (extruded portion) extruded to a face opposite the face of the plate-like material 40 to which the tapered portion 46 of the punch 41 is pressed against.

Figure 11:
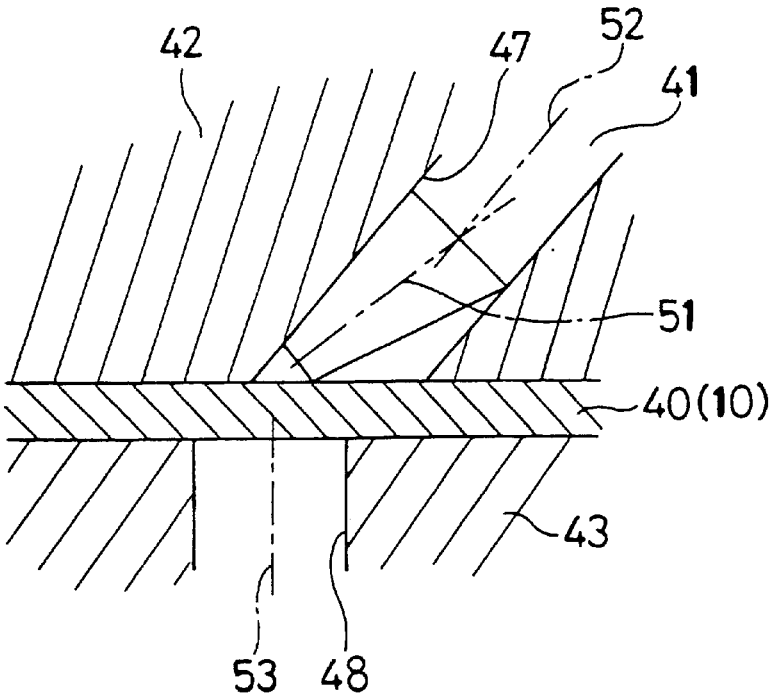
FIG. 11 is a schematic view showing a method of forming an injection hole of an electromagnetic type fuel injection valve according to an embodiment of the invention.

FIG. 11 shows yet another embodiment of the invention and is a view showing a method of working an injection hole of an orifice plate. According to the embodiment, the central axis line 53 of the discharge hole 48 of the die 43 is arranged on a line orthogonal to the face of the plate-like material 40. In transferring the plate-like material 40 in a successive step, there is hardly a possibility of a transfer in which the useless portion 45 shown in FIG. 9A is caught by the die 43. Therefore, retracting the punch 41 and transferring the plate-like material 40 to the next manufacturing step is facilitated.

Figure 12A:
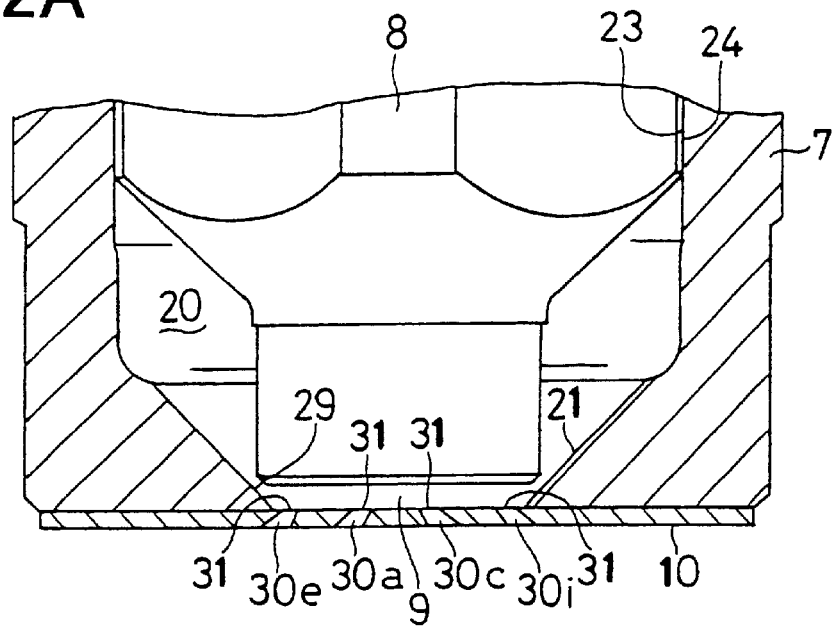
FIG. 12A is an enlarged sectional view showing a fuel injection nozzle of an electromagnetic type fuel injection valve according to an embodiment of the invention.
Figure 12B:
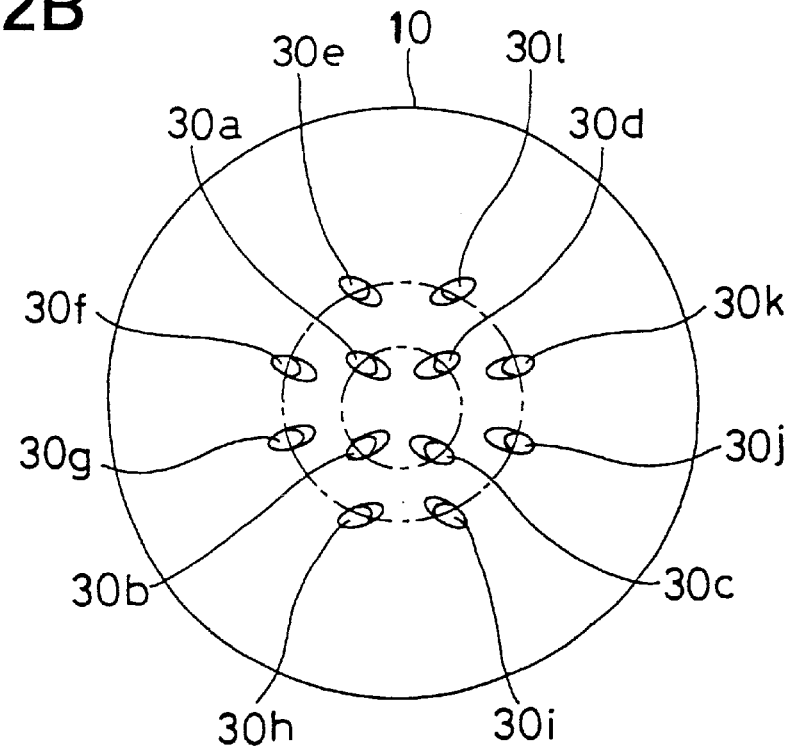
FIG. 12B is a plane view showing a plate with an injection hole viewed from a fuel inlet side according to an embodiment of the invention.

FIGS. 12A and 12B show yet another embodiment of the invention in which FIG. 12A is a view showing a fuel injection nozzle of an electromagnetic type fuel injection valve and FIG. 12B is a view showing an orifice plate viewed from a fuel inlet side.

According to the embodiment, the orifice plate 10 is formed with twelve (12) injection holes 30*a* through 30*l*. The injection holes 30*a* through 30*d* are arranged with the fuel inlets 31 on a circular periphery on an inner peripheral side and the injection holes 30*e* through 30*l* are arranged with the fuel inlets 31 on a circular periphery on an outer peripheral side. Further, directions of injecting fuel from the injection holes 30*a*, 30*b*, 30*e* 30*f*, 30*g* and 30*h* and directions of injecting fuel from the injection holes 30*c*, 30*d*, 30*i*, 30*j*, 30*k* and 30*l*, are directed to be opposed to each other by 180° and two direction injection is realized. Further, in the respective injection holes 30*a* through 30*l*, the relationship among θ1, θ2 and θ3 is the same as that of the first embodiment.

According to the embodiment, in the case of a fuel injection amount the same as that of the first embodiment, an injection amount per injection hole is reduced, because a diameter of the injection hole is reduced, thereby expediting small particle formation of the sprayed fuel. Further, the plurality of injection holes 30 can freely be arranged within a range so as not to deteriorate the effect of expediting the small particle formation of the sprayed fuel.

Although according to the embodiment, an explanation has been given of an example of attaching the fuel injection valve of the internal combustion engine such as the electromagnetic type fuel injection valve 1 (fuel injector) to the intake manifold of the gasoline engine, the fuel injection valve for the internal combustion engine may be attached to the combustion cylinder of the engine. The fuel injection valve may be attached to a combustion apparatus such as a water heater or an oil space heater. Further, according to the electromagnetic type fuel injection valve 1, with a purpose of maintaining a constant small particle formation expediting function, it is preferable to set a ratio of the plate thickness t (mm) of the orifice plate 10 to the injection hole diameter (fuel inlet diameter or fuel outlet diameter) of the injection hole 30 to a specific range.

Although according to the embodiment, an explanation has been given applying the embodiment to the electromagnetic type fuel injection valve 1 by reciprocating the nozzle needle 8 constituting the valve member of the fuel injection nozzle in the axial direction by utilizing the electromagnetic type actuator. However, the embodiment may be applied to a fuel injection valve for reciprocating the valve member mechanically in the axial direction. For example, the invention is applicable to a fuel injection nozzle in which a valve member is opened when fuel is supplied into a valve body to reach a predetermined oil pressure. Additionally, when a fluid is intended to be injected by subjecting the fluid to small particle formation, the fluid injection nozzle according to the invention may be used as such.

Additional advantages and modifications will readily occur to those skilled in the art. The invention in its broader terms is therefore, not limited to the specific details, representative apparatus, and illustrative examples shown and described.

What is claimed is:

1. An apparatus for working an injection hole of a fluid injection nozzle, the apparatus comprising:

a fluid injection nozzle having a valve body forming a fluid path inside thereof and having a valve seat and an orifice plate arranged at a front end face of the valve body, the orifice plate having at least one injection hole in a desired size with a divergent diameter from a fluid inlet to a fluid outlet, and a valve member for closing the fluid path by being seated on the valve seat and opening the fluid path by separating from the valve seat;

wherein a central axis line of the injection hole connecting a center of the fluid inlet of the injection hole to a center of the fluid outlet of the injection hole is inclined to a line perpendicular to a face of the orifice plate; and wherein a first intersection and a second intersection of imaginary lines drawn from a first face and a second face of the injection hole, respectively, are inclined to the central axis line of the injection hole and are also inclined to the line perpendicular to the face of the orifice plate;

a die mounted with a plate-like material before working the injection hole of the fluid injection nozzle;

a punch substantially in a shape of a truncated circular cone, a shape of a front end portion of the punch is provided with a first inclination angle and a second inclination angle relative to the line perpendicular to the face of the plate-like material;

a punch guide having a support hole for slidably supporting the punch such that a central axis line of the punch is inclined to the line perpendicular to the face of the plate-like material; and a punch driving means for advancing the punch along the central axis line of the punch guide;

wherein the punch guide uses a die structure capable of receiving a side force (Fs) from the front end portion of the punch produced in working the injection hole when the central axis line of the injection hole is inclined to the line perpendicular to the face of the plate-like material.

2. The apparatus of working an injection hole of a fluid injection nozzle according to claim 1:

wherein a first inclination angle formed by the first intersection on a side of an obtuse angle formed by the central axis line of the injection hole and an end face of the fluid inlet side of the orifice plate, and the line perpendicular to the face of the orifice plate, is designated by a notation θ1, and a second inclination angle formed by the second intersection on a side of an acute angle formed by the central axis line of the injection hole and the end face on the fluid inlet side of the orifice plate and the line perpendicular to the face of the orifice plate, is designated by a notation θ2, wherein θ1 is greater than or equal to 15°, and wherein θ1 is less than θ2.

3. The apparatus of working an injection hole of a fluid injection nozzle according to claim 1:

wherein a sliding face of an inner face of the punch guide on which the front end portion of the punch slides, is provided with the first inclination angle relative to the line perpendicular to the face of the plate-like material; and wherein a shape of a top portion of the front end portion of the punch is made parallel to the sliding face of the punch guide, the top portion of the front end portion of the punch guide also being parallel to the central axis line of the punch.

4. A method of working an injection hole of a fluid injection nozzle comprising the steps of:

holding a plate-like material between a die and a punch guide containing a punch;

extruding the plate-like material by advancing a front end portion of the punch into the plate-like material;

excluding a volume of the plate-like material by extruding the plate-like material into the die; and removing forwardly of a face of the plate-like material, the volume of the extruded material.

5. The method of working an injection hole of a fluid injection nozzle according to claim 4 further comprising the steps of:

setting a clearance between the front end portion of the punch and the die in a predetermined range relative to a plate thickness of the plate-like material, and removing the extruded portion by cutting, machining or grinding the extruded portion at a height consistent with the face of the plate-like material, after extrusion.

6. The method of working an injection hole of a fluid injection nozzle according to claim 4 further comprising the step of:

setting a clearance between the front end portion of the punch die to be equal to or smaller than a predetermined value, wherein during extrusion, the punch is pressed until the extruded portion is automatically separated from the plate-like material due to the clearance.

7. An apparatus for forming an injection hole of a fluid injection nozzle, the apparatus comprising:

a punch holder located adjacent to a die;

a plate-like material sandwiched between the punch holder and the die, the plate-like material defining a plurality of injection holes resulting in an orifice plate;

a punch located within a support hole of the punch holder, the punch having an end portion with a first peripheral portion defining a first angle θ1, with a line perpendicular to a face of the plate-like material, the punch also having a second peripheral portion at the end portion defining a second angle θ2, with the line perpendicular to a face of the plate-like material;

wherein the punch is subjected to a force (Fs) when the punch makes contact with the plate-like material, and wherein the force (Fs) is countered by a force (Fr), the force (Fr) being the reaction force to the force (Fs), wherein the canceling forces, (Fs) and (Fr) prevent a bending moment in the punch; and wherein the injection holes are directed so that a first group sprays in a first direction and a second group sprays in a direction 180 degrees from the first group, the directions being fixed.

8. The apparatus for forming an injection hole of a fluid injection nozzle according to claim 7:

wherein a central axis line of the injection hole connecting a center of the fluid inlet of the injection hole to a center of the fluid outlet of the injection hole is inclined to a line perpendicular to a face of the orifice plate; and wherein a first intersection and a second intersection of imaginary lines drawn from a first face and a second face of the injection hole, respectively, are inclined to a central axis line of the injection hole and are also inclined to the line perpendicular to the face of the orifice plate.

9. The apparatus for forming an injection hole of a fluid injection nozzle according to claim 8:

wherein a first inclination angle formed by the first intersection on a side of an obtuse angle formed by the central axis line of the injection hole and an end face of the fluid inlet side of the orifice plate, and the line perpendicular to the face of the orifice plate, is designated by a notation θ1, and a second inclination angle formed by the second intersection on a side of an acute angle formed by the central axis line of the injection hole and the end face on the fluid inlet side of the orifice plate and the line perpendicular to the face of the orifice plate, is designated by a notation θ2, wherein θ1 is greater than or equal to 15 degrees, and wherein θ1 is less than θ2.

* * * * *